US007387334B2

(12) United States Patent
Phipps

(10) Patent No.: US 7,387,334 B2
(45) Date of Patent: Jun. 17, 2008

(54) FOLDING CHAIR

(76) Inventor: Jake Phipps, Virtu, Studio 2R, Cooper House, 2 Michael Road, London (GB) SW6 2 AD ( * ) Notice: Subject to any disclaimer, the term of this patent is extended or adjusted under 35 U.S.C. 154(b) by 256 days.

(21) Appl. No.: 11/063,127

(22) Filed: Feb. 22, 2005

(65) Prior Publication Data

US 2006/0186711 A1 Aug. 24, 2006

(51) Int. Cl.
*A47C 4/00* (2006.01)

(52) U.S. Cl. ..... 297/55; 297/17

(58) Field of Classification Search ..... 297/17, 297/46, 47, 48, 49, 50, 55, 57
See application file for complete search history.

(56) References Cited

U.S. PATENT DOCUMENTS

| | | | | | |
|---|---|---|---|---|---|
| 130,327 | A | * | 8/1872 | Stewart | 297/49 |
| 180,073 | A | * | 7/1876 | Skinner | 297/48 |
| 465,500 | A | * | 12/1891 | Segar | 297/50 |
| 491,215 | A | * | 2/1893 | Kehr | 297/50 |
| 793,507 | A | * | 6/1905 | Cobb | 297/156 |
| 1,254,329 | A | * | 1/1918 | Kidder | 297/50 |
| 1,396,794 | A | * | 11/1921 | Travers | 297/50 |
| 1,430,732 | A | * | 10/1922 | Elzey | 297/49 |
| 1,675,577 | A | * | 7/1928 | Rosenthal et al. | 297/57 |
| 1,714,323 | A | * | 5/1929 | Simmons | 297/48 |
| 1,720,488 | A | * | 7/1929 | Lier | 188/2 R |
| 2,074,998 | A | * | 3/1937 | Kaufman | 297/48 |
| 2,216,316 | A | * | 10/1940 | Karish | 297/50 |
| D140,672 | S | * | 3/1945 | Platt | D6/368 |
| 2,464,450 | A | * | 3/1949 | Karish | 297/50 |

(Continued)

FOREIGN PATENT DOCUMENTS

GB 2 204 232 11/1988

(Continued)

OTHER PUBLICATIONS

Search Report dated Jul. 8, 2004.

*Primary Examiner*—Joseph F Edell
(74) *Attorney, Agent, or Firm*—Lerner, David, Littenberg, Krumholz & Mentlik, LLP

(57) ABSTRACT

A folding chair which can be opened from a folded closed position to an operative open position comprising a substantially rectangular open support frame, a lower part of which provides a front support leg when in the open position; a seat portion, a back portion and a lower seat support a lower part of which provides a rear support leg when in the open position; the seat portion, back portion and lower seat support being located within the open support frame and pivoted together and to the frame to allow the seat portion to extend between the lower seat support and the back portion and lower seat support to lie parallel to each other within the rectangular support frame when in the folded closed position, the back portion being pivotally connected to the rectangular support frame through a sliding pivot, the seat portion being pivoted to the back portion and the lower seat support being connected to the lower part of the back support through a pivoted link or links, the lower part of the lower seat support rotating from a lower position where it provides the rear support leg when the chair is in its open position to an upper position within the open support frame when the chair is closed to its folded position.

22 Claims, 17 Drawing Sheets

U.S. PATENT DOCUMENTS

| | | | | | |
|---|---|---|---|---|---|
| 2,493,084 | A | * | 1/1950 | Pharo | 297/48 |
| 3,767,190 | A | * | 10/1973 | Biggerstaff | 482/142 |
| D390,022 | S | * | 2/1998 | Jus | D6/368 |
| 6,896,322 | B1 | * | 5/2005 | Foy | 297/14 |

FOREIGN PATENT DOCUMENTS

| | | |
|---|---|---|
| GB | 2 386 832 | 10/2003 |

* cited by examiner

FOLDING CHAIR

BACKGROUND OF THE INVENTION

This invention relates to a folding chair which, when folded, will occupy a minimum amount of space but which when in operative open position will provide an attractive appearance.

It also includes a folding chair which is convertible into a framed picture.

An advantage of the construction is that all the parts can be housed within an outer support frame which thus provides a slim configuration when in the closed position.

SUMMARY OF THE INVENTION

According to the present invention a folding chair which can be opened from a folded closed position to an operative open position comprises a substantially rectangular open support frame, a lower part of which provides a front support leg when in the open position; a seat portion, a back portion and a lower seat support a lower part of which provides a rear support leg when in the open position; the seat portion, back portion and lower seat support being located within the open support frame and pivoted together and to the frame to allow the seat portion to extend between the lower seat support and the back portion and lower seat support to lie parallel to each other within the rectangular support frame when in the folded closed position, the back portion being pivotally connected to the rectangular support frame through a sliding pivot, the seat portion being pivoted to the back portion and the lower seat support being connected to the lower part of the back support through a pivoted link or links, the lower part of the lower seat support rotating from a lower position where it provides the rear support leg when the chair is in its open position to an upper position within the open support frame when the chair is closed to its folded position.

With this construction the sliding pivot between the back portion and the rectangular support frame can include a track extending lengthwise on the inside of each side of the rectangular support frame.

In a first preferred construction the seat portion, the back portion and the lower seat support each include a series of parallel slats, the upper ends of the slats on the lower seat support extending between the forward ends of the adjacent slats of the seat portion, and the rearward ends of the slats of the seat portion extending between the slats of the back portion. This arrangement allows the forward parts of the seat portion to extend into the upper end of the lower seat support and the rearward ends of the slats of the seat portion to extend into the back portion when the back portion and the lower seat support are collapsed together in parallel symmetry.

The pivot between the seat and the lower seat support can be provided by a first pivot pin which extends through their respective slats and the pivot between the seat and the back portion can be provided by a second pivot pin which extends between their respective slats.

In a second preferred construction the seat portion, the back portion and the lower seat support are made from a rigid sheet material.

In this construction the lower seat support is connected to the lower portion of the back support through a single link.

The surfaces of the lower seat support and the back support can be recessed to accommodate the link when the chair is in the folded closed position.

The chair can be constructed from any convenient material, for example wood, metal or a synthetic plastics material. In order to restrict the weight a metal material could be aluminum.

The upper end of the rectangular support frame may conveniently carry a lifting handle.

The invention also includes a folding chair which is convertible into a framed picture and which can be folded from an open position in which it provides a seat to a folded position in which it provides a framed picture, and which includes a rectangular open support frame and portions which provide legs, a seat and a back when in the open position and which, when in the folded position, are all enclosed within the support frame and form a substantially flat continuous or perforated surface, and an image carried on the surface which is surrounded by the support frame when in the folded position to provide a framed picture.

The substantially flat continuous or perforated surface to carry an image can be provided on both sides of the folded chair.

In one preferred embodiment the surface is provided by the surface of the back portion.

The flat surface can also be provided by a surface of a lower seat support which forms the rear leg or legs of the chair when in the open position.

In another construction the surface can be provided by a surface of the back portion in combination with the surface of the seat portion.

In yet another construction the flat surface can be provided by a surface of the lower seat support which forms the rear leg or legs of the chair when in the open position in combination with the surface of the seat portion.

In a convenient construction the rectangular open support frame has a lower part which provides a front support leg when the chair is in the open position; a seat portion, a back portion and a lower seat support a lower part of which provides a rear support leg when in the open position; the seat portion, back portion and lower seat support being located within the open support frame and pivoted together and to the frame to allow the seat portion to extend between the lower seat support and the back portion and lower seat support to lie parallel to each other within the rectangular support frame when in the folded closed position, the back portion being pivotally connected to the rectangular support frame through a sliding pivot, the seat portion being pivoted to the back portion and the lower seat support being connected to the lower part of the back support through a pivoted link or links, the lower part of the lower seat support rotating from a lower position where it provides the rear support leg when the chair is in its open position to an upper position within the open support frame when the chair is closed to its folded position.

The further constructional details of the chair can be as set out above.

IN THE DRAWINGS

The invention can be performed in various ways and a number of embodiments will now be described by way of example and with reference to the accompanying drawings in which.

DETAILED DESCRIPTION OF THE DRAWINGS

Figure 1:
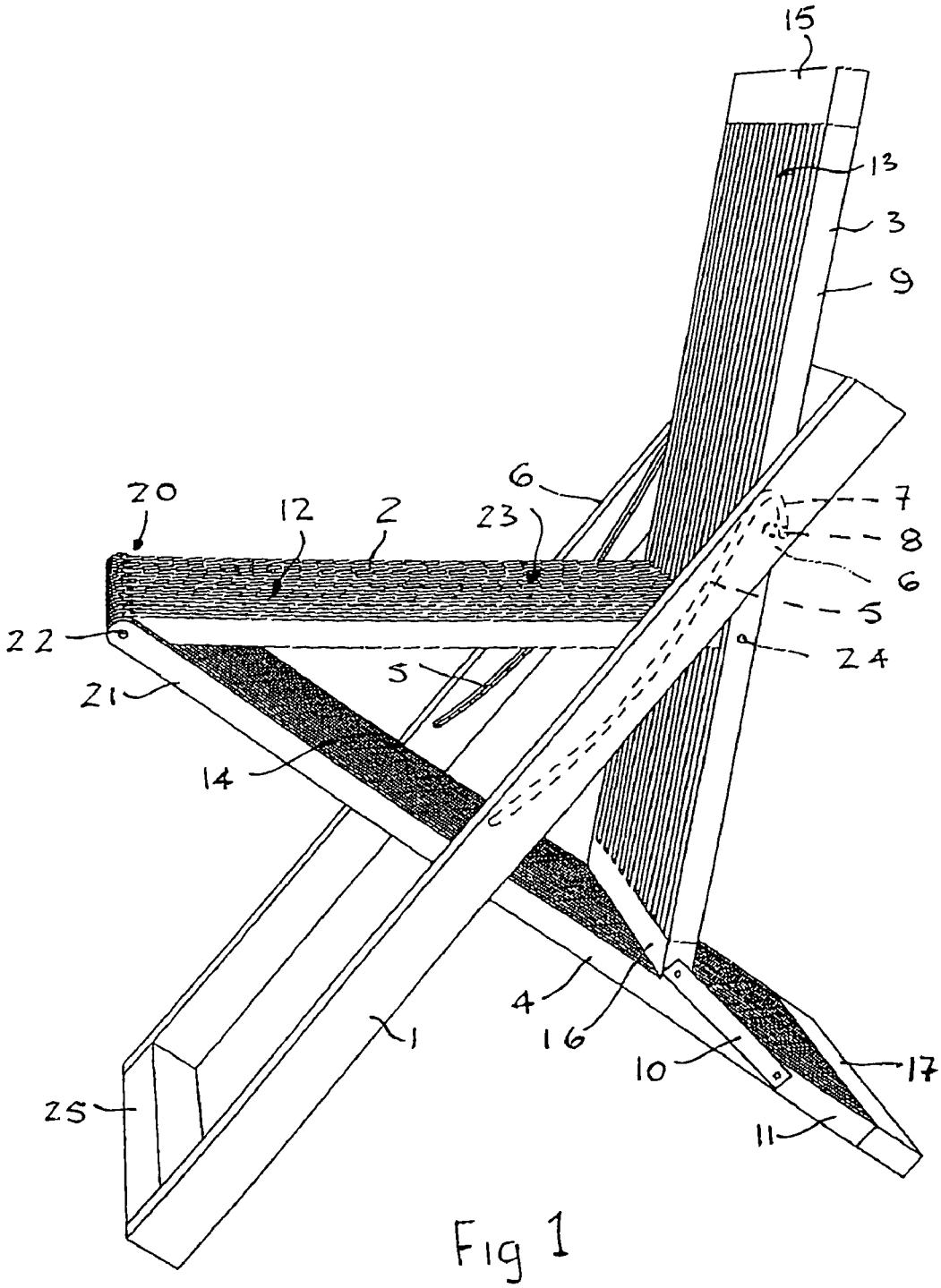
FIG. 1 is an isometric front view of the folding chair according to the invention in an operative open position.

As shown in FIG. 1 the folding chair which is movable from an operative open position to a folded closed position is shown in the open operative position and comprises a substantially rectangular support frame 1 which can be 3 cm wide and within which are located a seat portion 2, a back portion 3 and a lower seat support 4. The back portion 3 is pivotally connected to the rectangular support 1 through a sliding pivot which includes a track 5 extending lengthwise on the inside of each side 6 of the rectangular support frame 1. The track 5 is curved and at its upper end has a re-entrant shape 7 which is most clearly shown in FIGS. 4 and 5. The back portion 3 carries a pivot pin 8 on each of its side edges 9 and which locates in the track 5. In FIG. 1 the pin 8 is at the upper end of the track 5, has passed around the top end and into the re-entrant portion 7 to hold the back portion in place. The lower end of the back portion 3 is connected through a pair of pivoted metal links 10 to the side edges 11 of the lower seat support 4.

The seat portion 2, the back portion 3 and the lower seat support 4 include a series of parallel slats which are identified respectively by reference numerals 12, 13 and 14.

Figure 2:
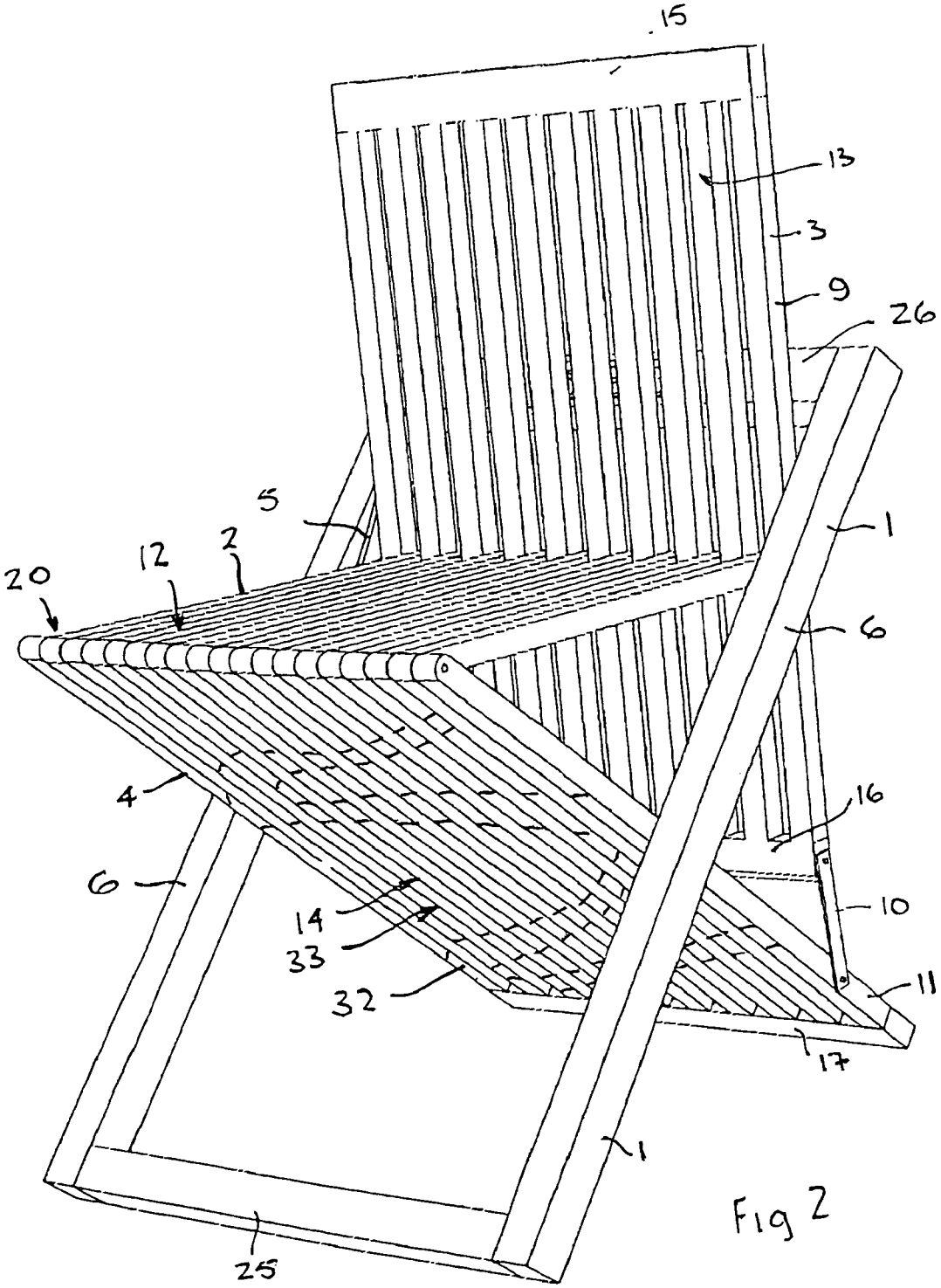
FIGS. 2 to 5 show the folding chair in various positions as it is folded.

The slats are spaced apart so that there is a gap between adjacent slats which is of the same width as the thickness of the slats themselves, as is most clearly shown in FIG. 2. The upper and lower ends of the back portion 3 are provided by cross members 15 and 16 and the lower end of the lower seat support is formed by a cross member 17.

The seat portion 2 consists of the slats 12 and the front end 20 is connected to the upper end 21 of the lower seat support 4 by a first pivot pin 22 which extends through the slats 12 and 14 of the seat portion and lower seat support to provide a pivoted connection. Similarly the rearward ends 23 of the slats 12 of the seat portion 2 extend between the slats 13 of the back portion 3 and are held in place by a second pivot pin 24 which extends between the respective slats 12 and 13.

In the construction described the chair is intended to be made from wood but it could be made from metal, for example aluminum, or a synthetic plastics material.

As mentioned above FIG. 1 shows the chair in its operative open position. When it is desired to collapse the chair to a folded position the back portion 3 is first raised so that the pins 8 emerge from the re-entrant portion 7 of the slot 5, this movement being accommodated through the pivoted links 10 and the pins 8 are moved down the slot 5. In FIG. 2 it will be seen that the links 10 have been moved to an upward position and the back portion 3 has been moved slightly forwards. At the same time the lower seat support has been rotated forwards and moved within the support frame 1.

Figure 3:
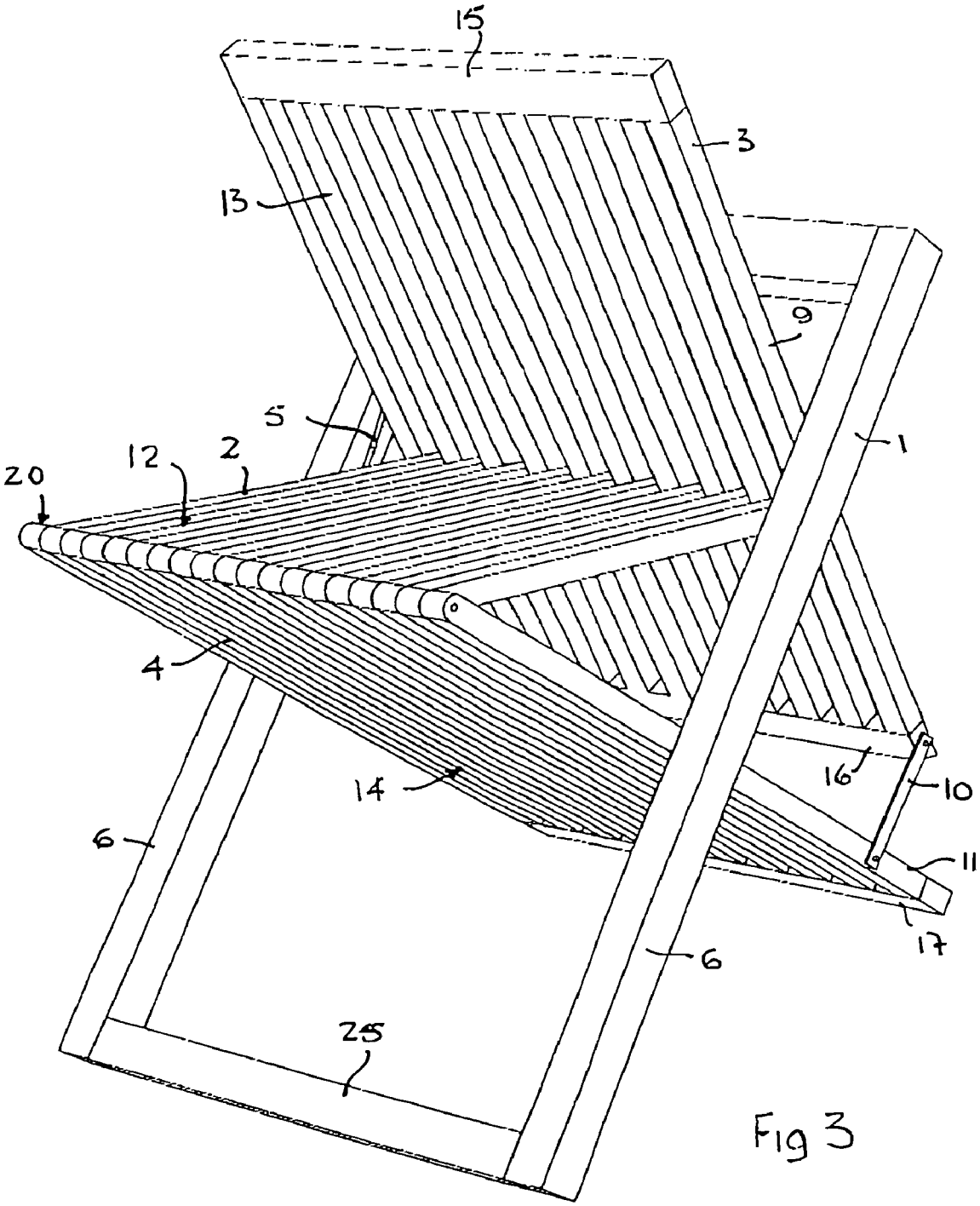

FIG. 3 shows the continued operation of collapsing the chair by continuing to move the back portion 3 by rotating it and moving it down the slots 5 which at the same time tilts the forward end of the lower seat support forwards and downwards.

Figure 4:
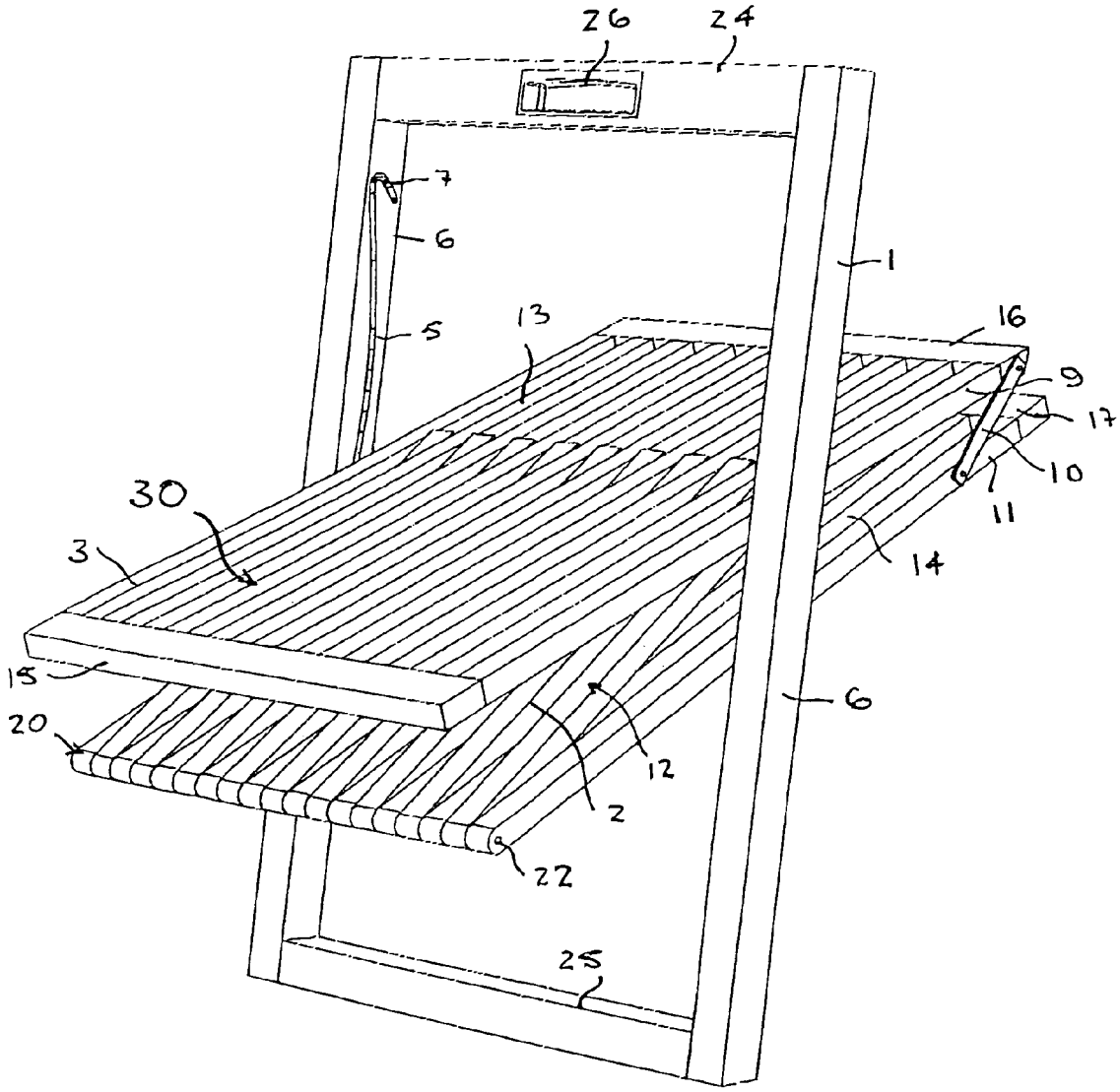

FIG. 4 shows the continued rotational movement of the back support 3 and downward movement of the pins 8 in the track 5. The continuous rotation allows the slats 12 of the seat portion 2 to fold within the slats 13 and 14 of the lower seat support 4 and back portion 3. At the same time the links 10 pivot to a rearward lower position.

Figure 5:
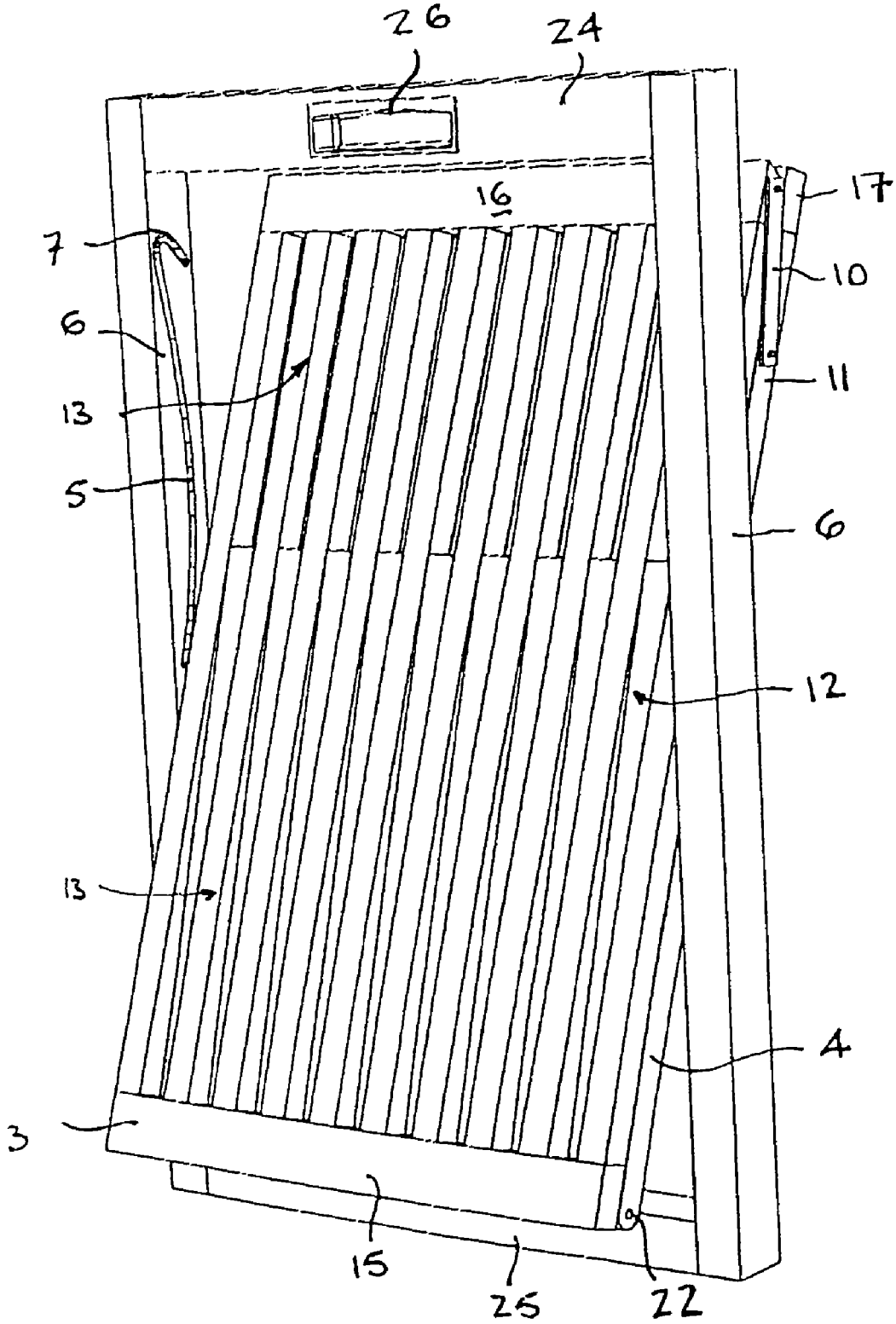

FIG. 5 shows the seat portion 2 formed by the slats 12 almost completely located within the back support slats 13 and the lower seat support slats 14. The seat 2 is now within the slats of the back portion 3 and lower seat support 4, the back 3 and the lower seat support 4 are substantially parallel and the lower end of the lower seat support 4 provided by the member 17 is now at the upper end of the chair.

Further rotation produces the folded position in which the seat portion 2 lies within the lower seat support 4 and the lower seat support 4 and the back portion 3 are parallel to each other and within the rectangular support 1.

The width of the various components are arranged so that the back portion 3 and lower seat support 4, when parallel, are substantially the same width as the side members 6 and upper cross member 24 and lower cross member 25 so that the folded chair is only 3 cms wide.

Figure 6:
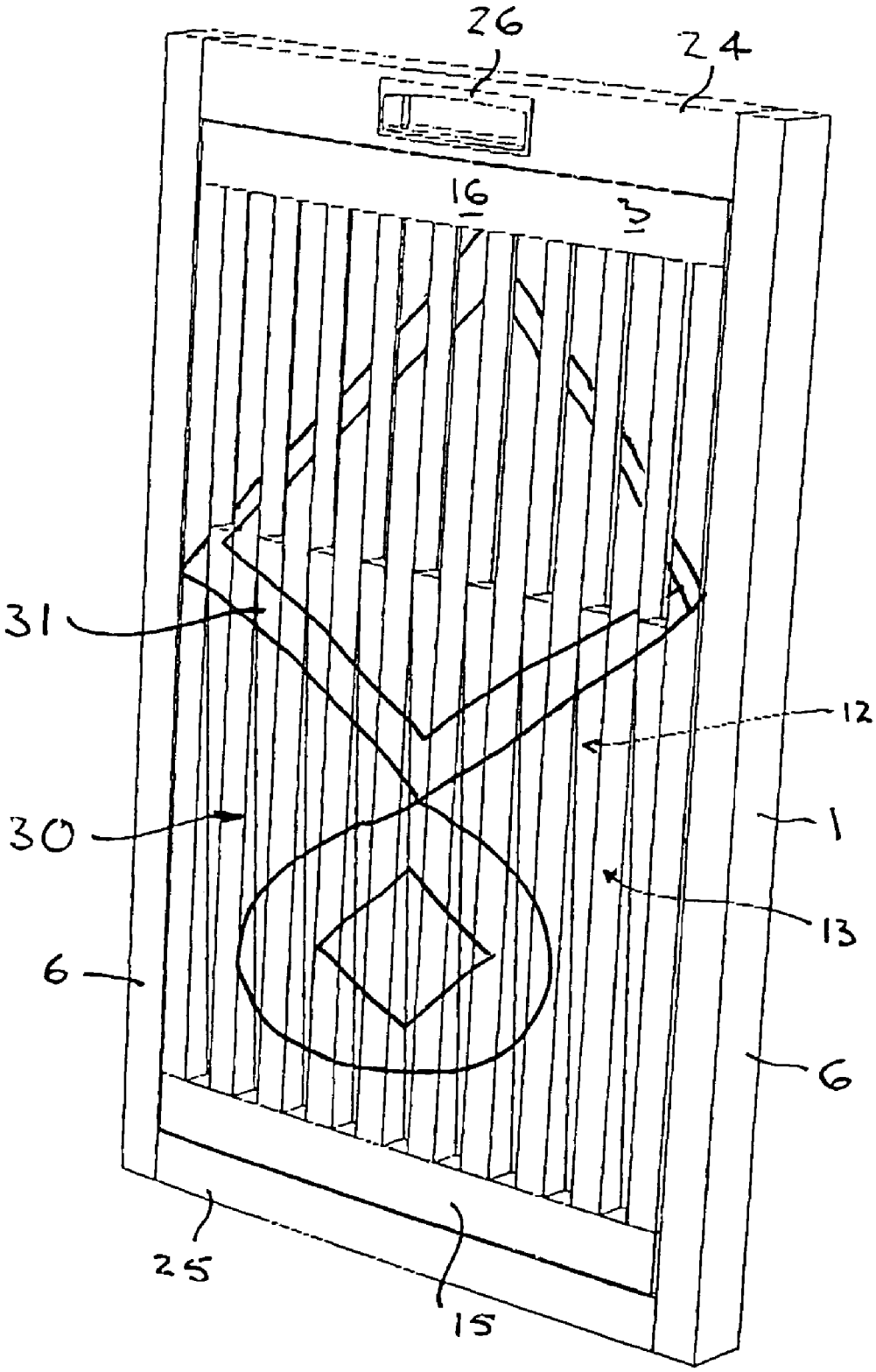
FIG. 6 shows the folded chair in its folded, closed position.

As shown in FIGS. 4, 5 and 6 a carrying handle 26 can be provided in the upper cross member 24.

The folded chair is easily moved from the folded to the operative open position merely by lifting the cross member 15 of the back portion 3 rearwardly which causes the back portion to rotate about its pivots in the track 5, continued movement causing the pins in the track to slide upwardly until they are locked into position. Thus the method of opening is merely the reverse of the method of closing.

In the arrangement described above the seat portion, back portion and lower seat support are provided with slats. In an alternative construction the back support and seat support could be open rectangular frames and the seat portion could also be a frame provided with a flexible seat made from, for example a synthetic plastics material or a fabric.

As will be seen from the drawings the back portion 3 has a series of parallel slats 3 which, on its rear side, provide a flat perforated surface 30 which is best seen in FIG. 4. When the seat is in the closed position, as shown in FIG. 6, it will be seen that the surfaces of the slats 12 of the seat portion also contribute to the surface so that it is substantially solid over about two thirds of the total surface and the remaining portion being provided by the slats 13 alone.

Figure 17:
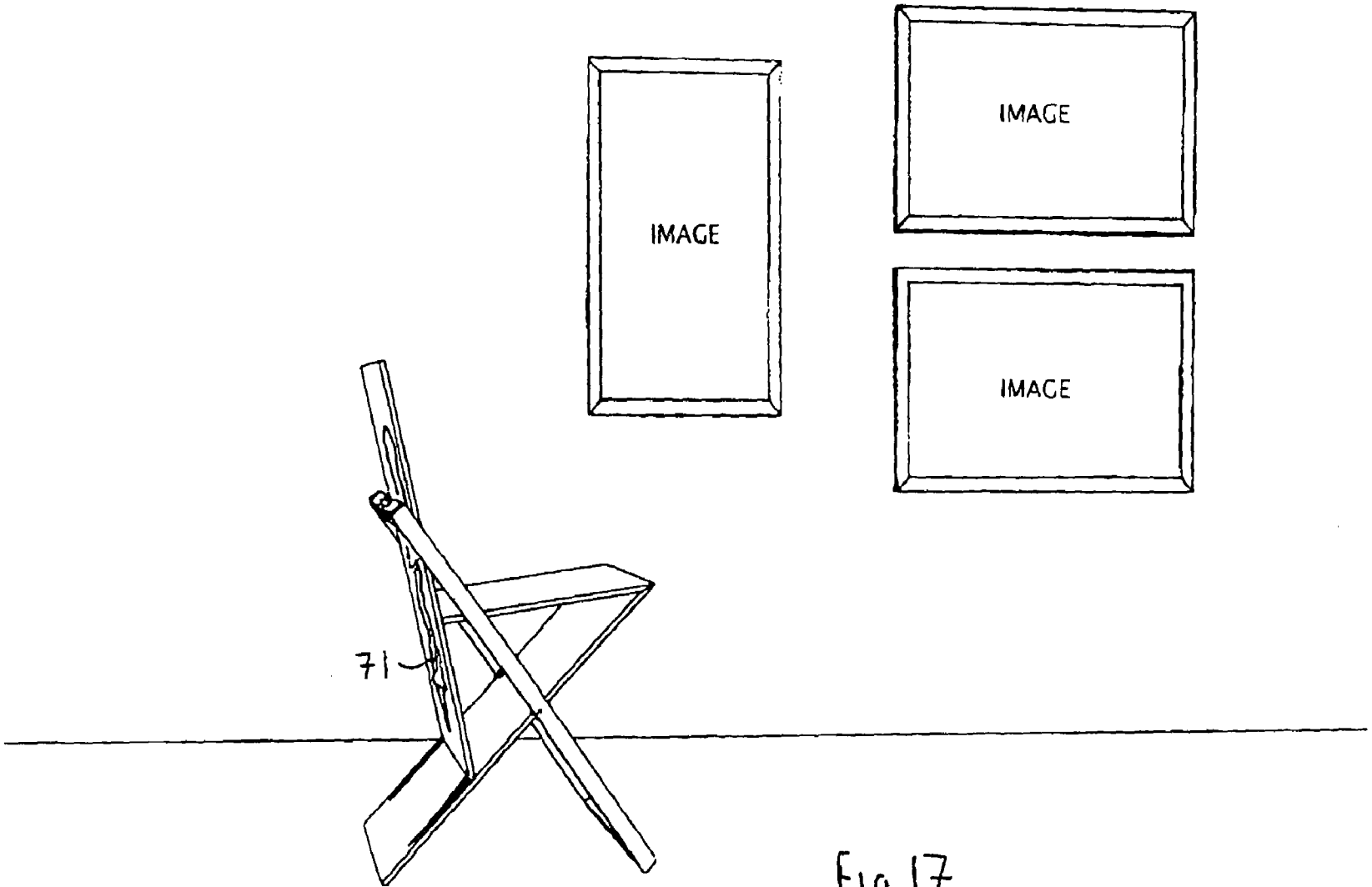

This substantially flat and substantially solid over two thirds, the remaining third being perforated, provides a surface on which there is an image indicated by reference numeral 31. This is only shown in FIG. 6. The image is in the form of an abstract pattern but it could be any other subject, for example a portrait, a picture of a scene or any other kind of image. The outer frame 1 provides a frame for the picture and as shown in FIG. 17 can be hung on a wall. In FIG. 17, three chairs are hung on a wall in different positions and a chair which has been taken from the wall and opened is shown.

An image 32 can also be provided by the substantially flat partly solid and partly perforated surface 33 which is formed by the what is the lower surface of the seat support 4. Again, the surface provided is similar to the surface 30 in as much that part of it is formed by the seat slats 12 moving into position between the seat slats 14 of the seat support member. The lower surface of the seat support member is best shown in FIGS. 2 and 3 before the seat slats 12 are fully in position. The image 32 is again shown as an abstract pattern but could be a portrait or a picture of anything else.

Thus, a picture can be provided on each side of the folded chair which is surrounded by a frame and is clearly reversible to use whichever picture is required.

Figure 7:
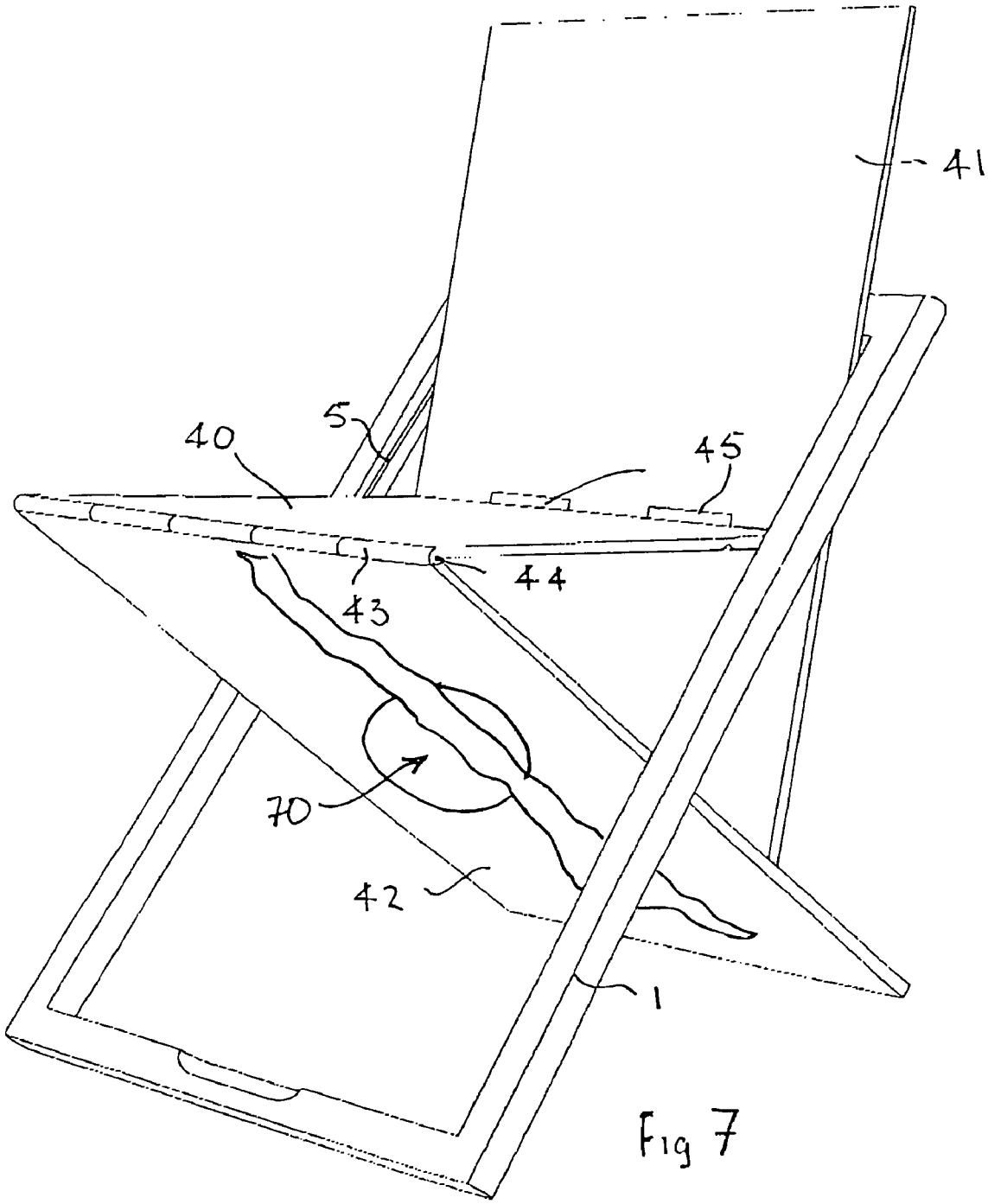
FIG. 7 is an isometric front view of a second construction according to the invention.
Figure 8:
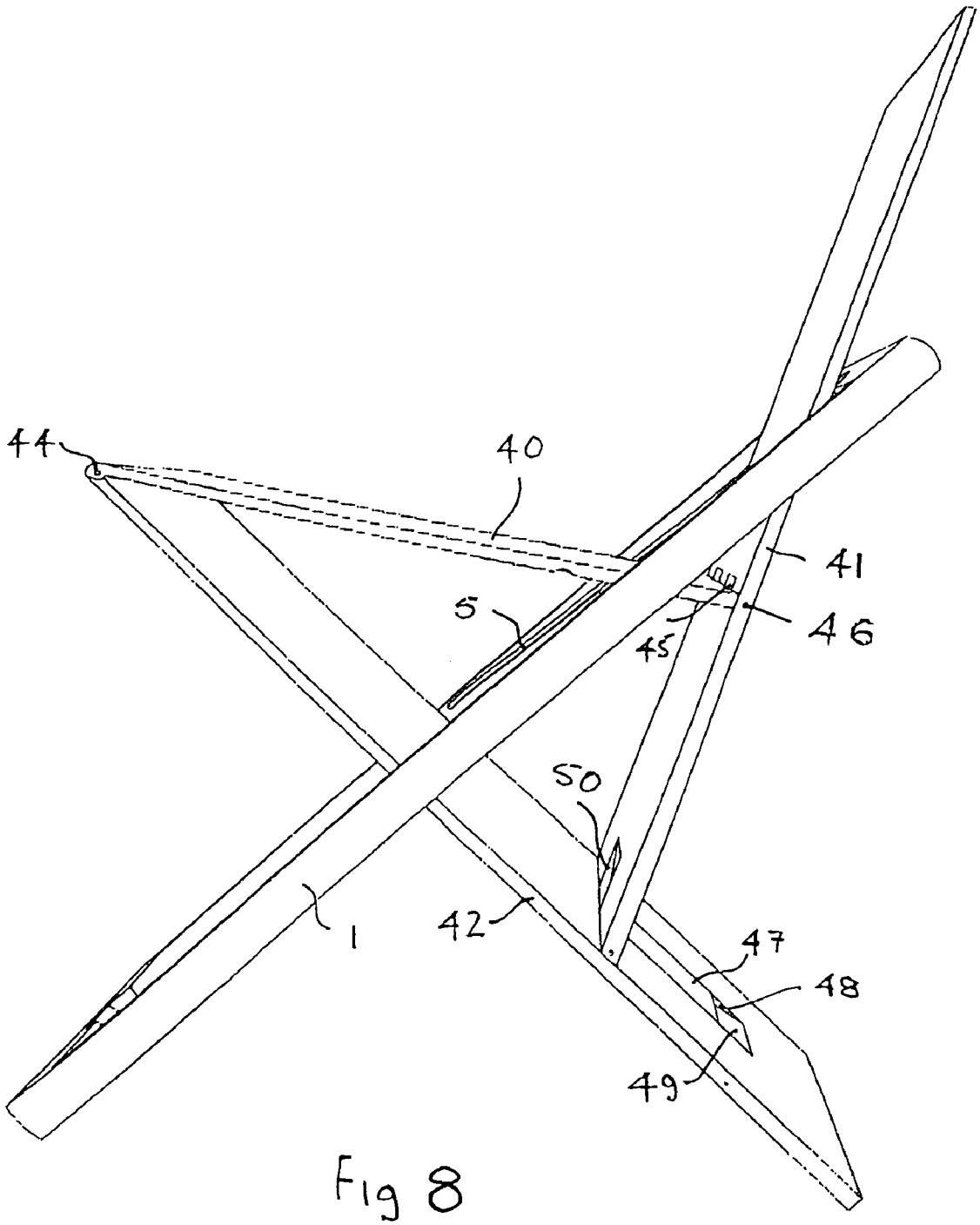
FIG. 8 is a side elevation of the chair shown in FIG. 7.
Figure 9:
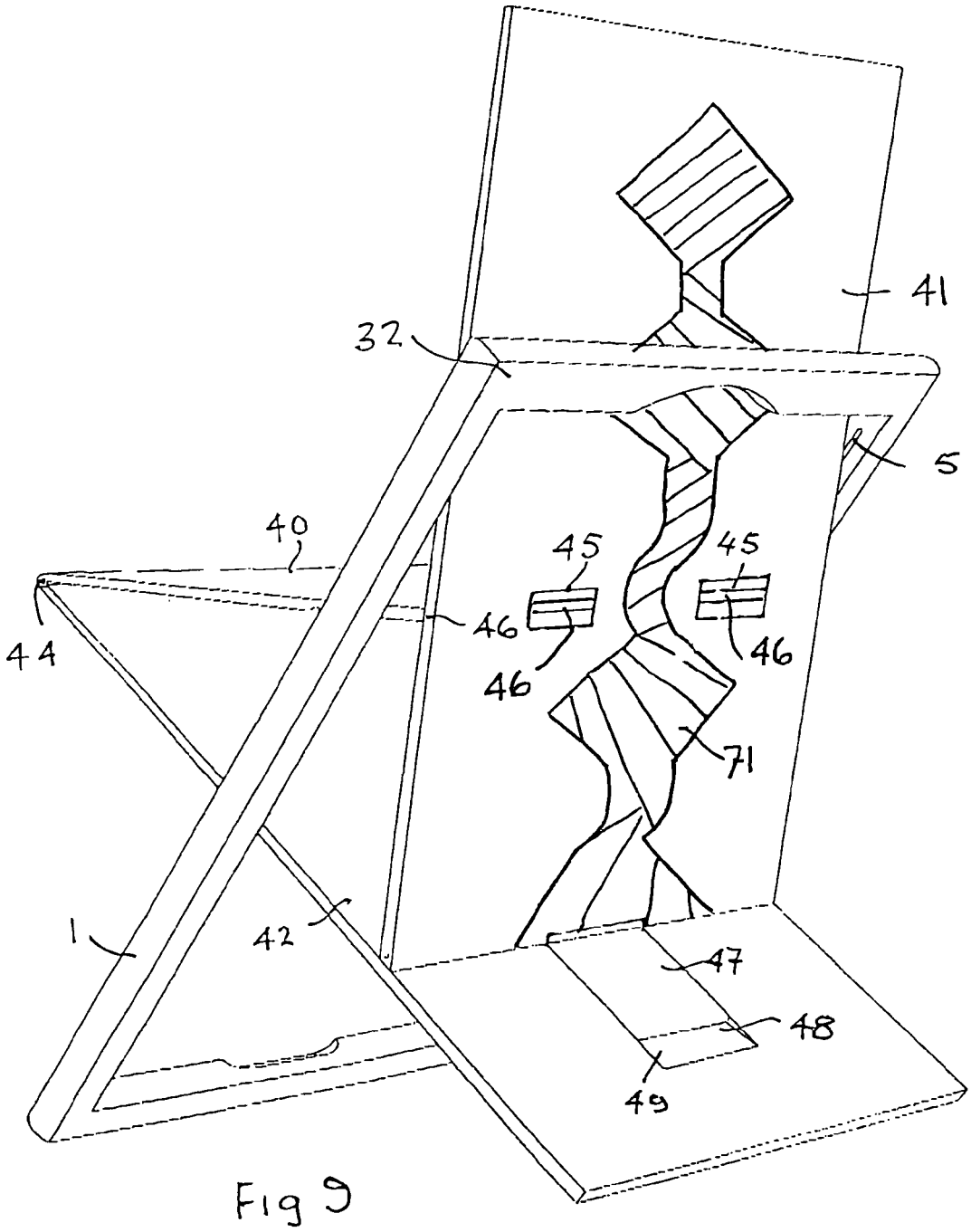
FIG. 9 is an isometric view of the chair shown in FIGS. 7 and 8.

FIGS. 7, 8 and 9 show another preferred construction which operates in a similar manner to that described with regard to FIGS. 1 to 7 and similar reference numerals are used to indicate similar parts. In this construction however the seat portion, indicated by reference numeral 40, a back portion, indicated by reference numeral 41, and lower seat support, indicated by reference numeral 42, are made from a rigid sheet material, for example synthetic plastics material. The material is strong and rigid enough to support a user's weight and the front of the seat portion 40 is suitably shaped as a hinge 43 which is connected by a hinge pin 44 to the upper end of the lower seat support 42. The rear end of the seat 40 is similarly hinged to the back portion 41 by providing openings 45 and a suitable pin 46.

In this construction the lower seat support 42 is connected to the lower portion of the back support 41 through a single link 47. The surface of the lower seat support 42 has a recess 48, the end of which is provided as an inclined ramp 49, to accommodate the link 47 when the chair is in the folded closed position. Similarly the lower end of the back support also has a recess 50 again to accommodate the link 47 when the chair is in the folded position.

A carrying handle 57 is again provided.

Figure 11:
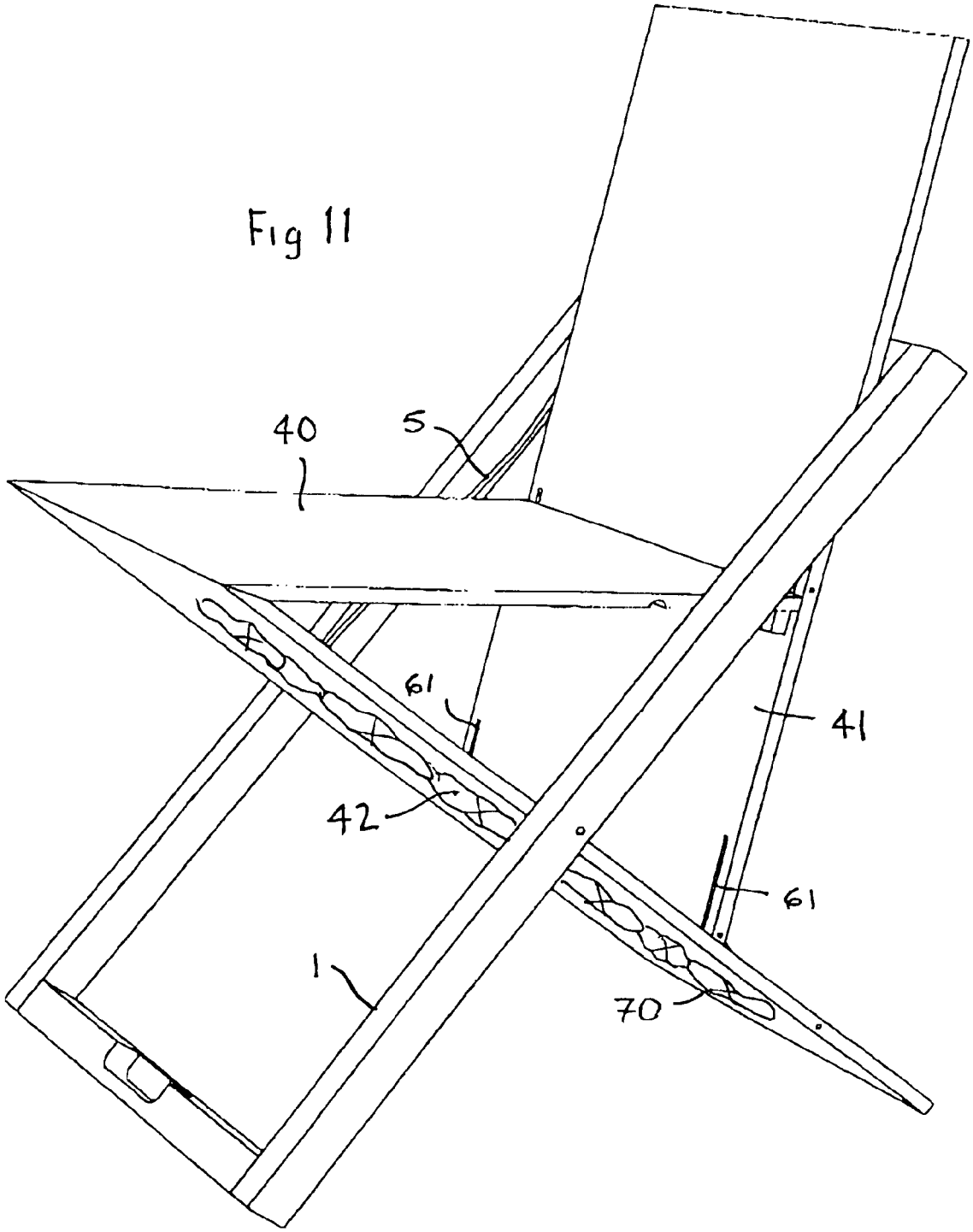
FIG. 11 is an isometric front view of a further embodiment of a chair according to the invention.
Figure 12:
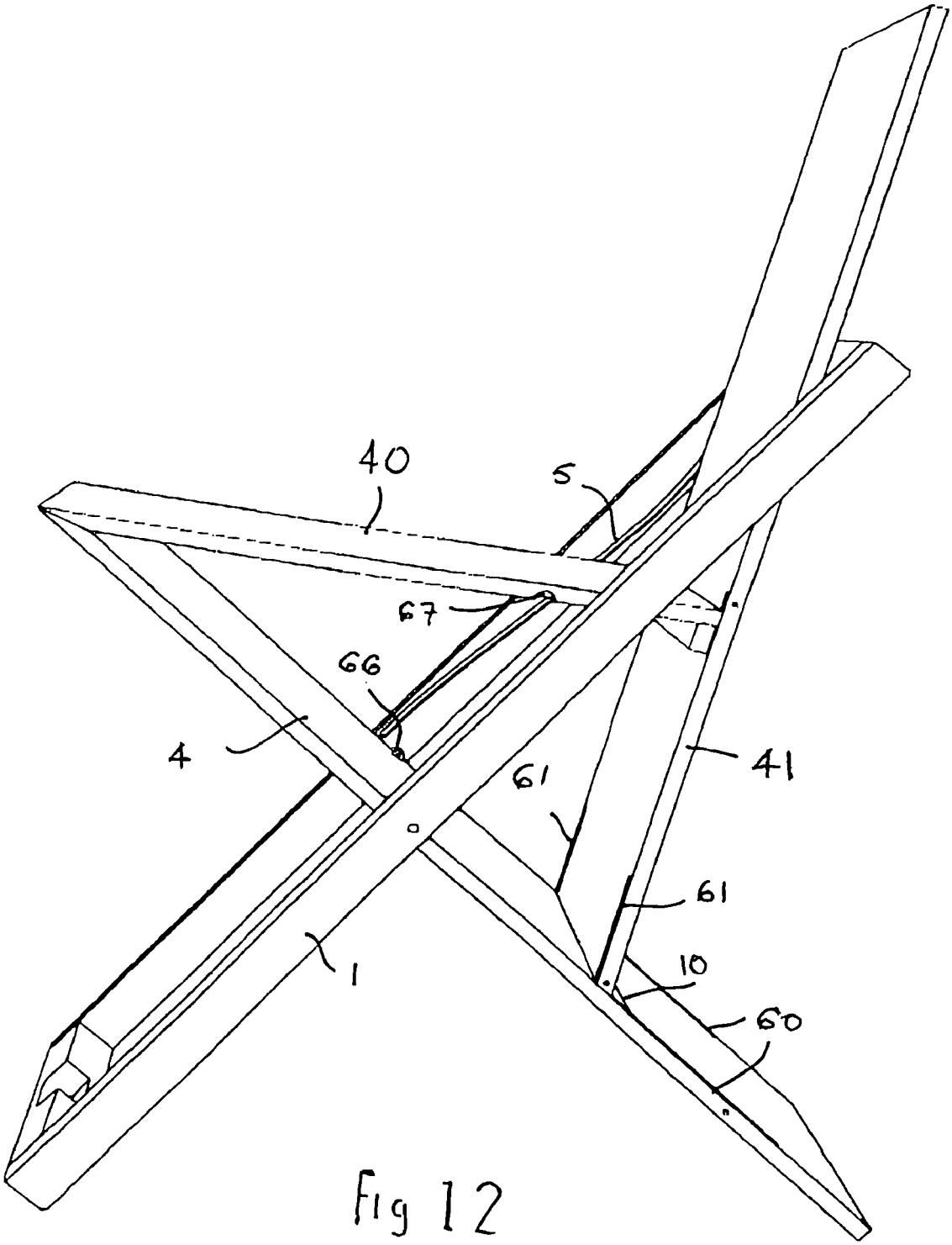
FIG. 12 is a side view of the chair as shown in FIG. 11.
Figure 13:
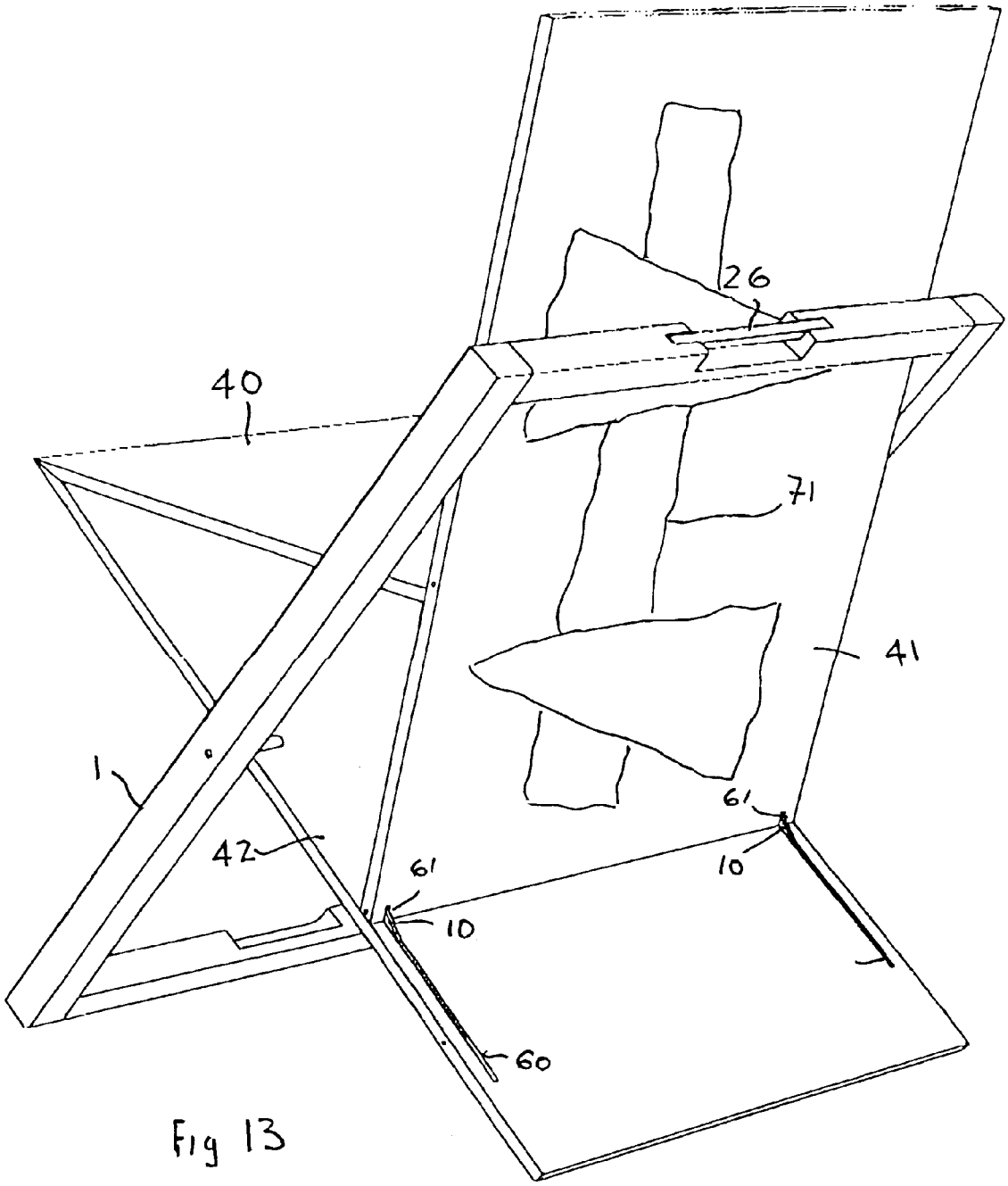
FIG. 13 is a rear perspective view of the chair shown in FIGS. 12, 11 and 10.

FIG. 11 shows another alternative construction which embodies some of the features of two of the previous constructions described above and similar reference numerals are used to indicate similar parts.

Figure 10:
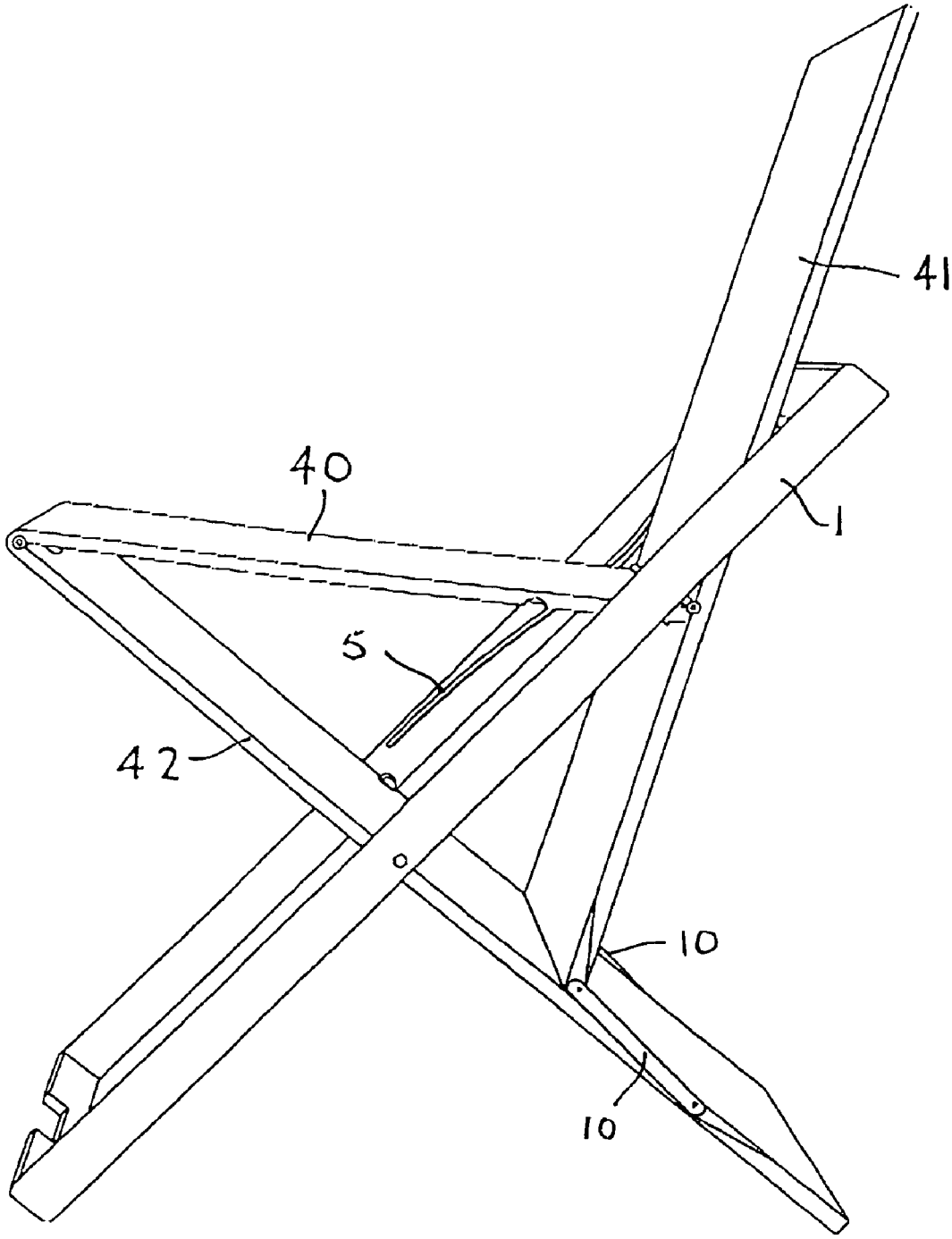
FIG. 10 is a side elevation of an alternative construction embodying some of the features of the both the previous constructions.

In this construction the seat portion 40, a back portion 41 and lower seat support 42 are again made from a rigid material in a similar manner to the construction shown in FIGS. 8, 9 and 10 and are pivoted together in a similar way apart from the use of a single link. The single link 47 of the construction shown in FIGS. 8. 9 and 10 is replaced by pivoted links 10 similar to those used in FIGS. 1 to 6.

The rectangular support frame 1 is of similar configuration to the support frames shown in the other Figures but is made from a light metal, for example aluminium, which can be polished to provide an attractive appearance. In the construction being described the seat portion 40, back portion 41 and lower seat support 42 are made from wood, for example laminated plywood, but they could alternatively be made from, for example, plastics material.

With the various parts assembled within the support frame the use of metal provides protection for the edges of the material used for the other parts.

It will be appreciated that in all the constructions described above the seat portion, back portion and lower seat support are located within the rectangular support frame 1 when in the closed position.

FIGS. 12 to 15 show another alternative construction in which the same reference numerals to the previous embodiments are used to indicate similar parts. Flat synthetic plastics materials are again used for seat portion 40, back portion 41 and lower seat support 42. In this construction the edges of the seat portion 40 and seat support portion 42 are chambered as indicated by reference numeral 55 and 56 respectively. Separate hinges 57 are provided which allow the parts to assume the position shown in FIGS. 11 to 13 but which can open appropriately as required for the folding process.

Figure 14:
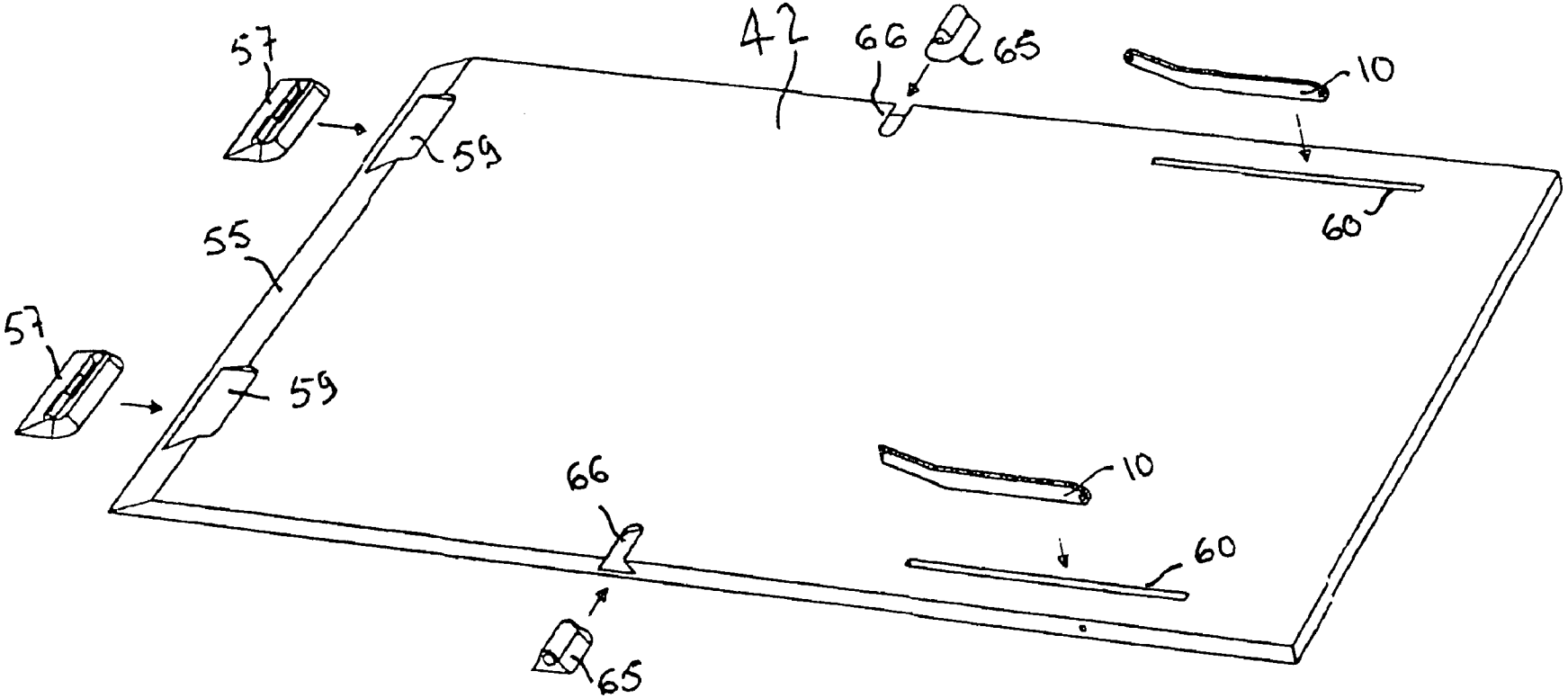
FIG. 14 is an exploded isometric view showing the construction of any lower seat support of the kind used in FIGS. 11 to 13.
Figure 15:
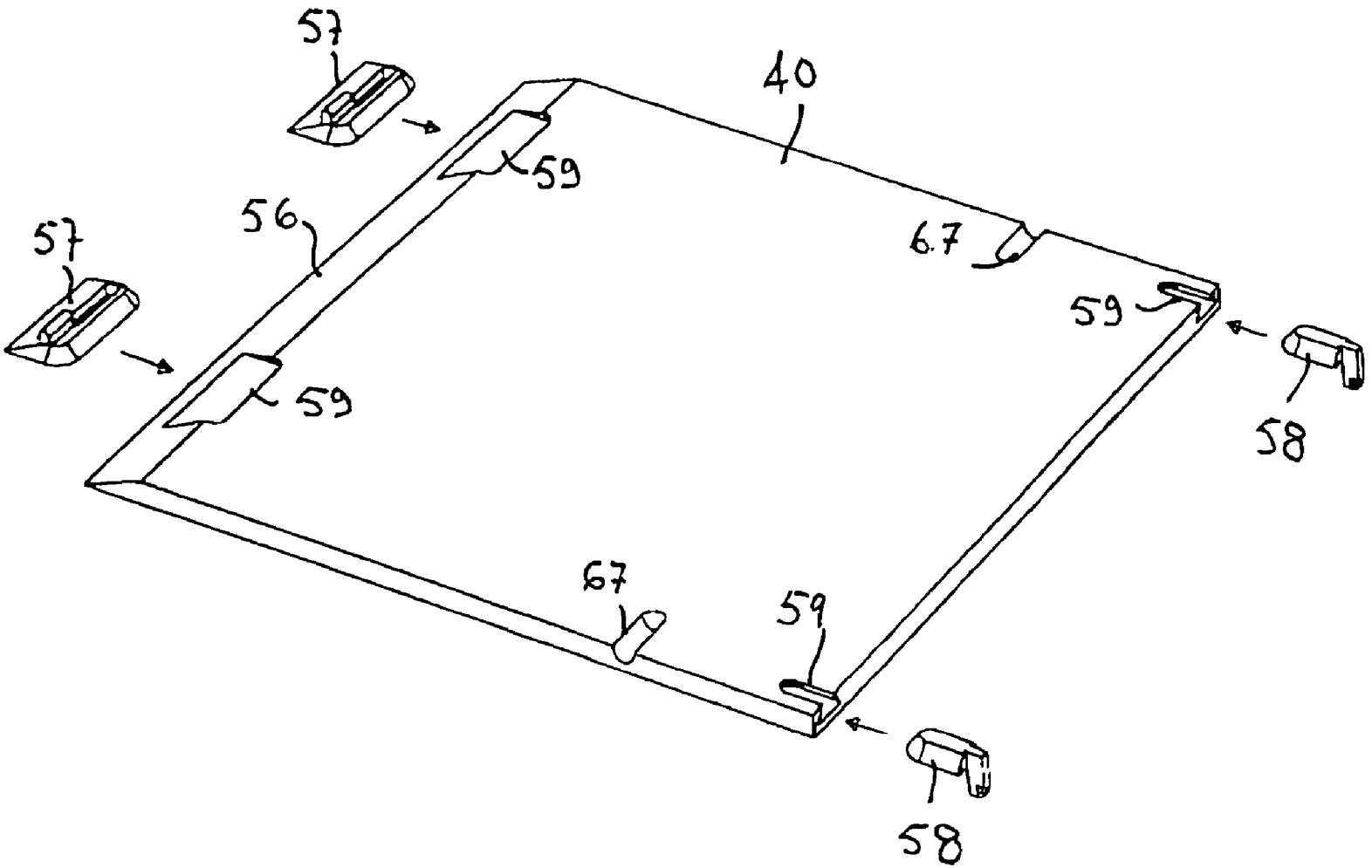
FIG. 15 is an isometric exploded view of the seat used in the construction shown in FIGS. 11 to 13.

It will be appreciated that FIGS. 14 and 15 are exploded isometric views showing the seat portion and seat support portion and their accompanying fittings and hinges.

The seat rear hinges which connect the seat to the back support 41 are indicated by reference numeral 58 and are fitted in slots 59 in the seat portion 40. The front hinges 57 are located in cut-outs 59 in the seat and lower seat support.

Pivoted links 10 are used but are angled and pivoted within slots 60 in the lower seat support 42 and slots 61 in the back support 41. The slots 61 are chambered so that they extend further up the front side of the rear seat support than the rear as will be clear from inspection of FIGS. 11 and 13. Separate seat hinges 65 are provided which fit in dovetail slots 66 in the lower seat support and the protruding upper part of each hinge is accommodated in grooves 67 in the lower surface of the seat when the chair is in the folded position.

This particular construction provides a pleasing and attractive appearance.

An image can again be provided on the appropriate face of the back portion 41 and lower seat support 42 as indicated by reference numerals 70 and 71.

Figure 16:
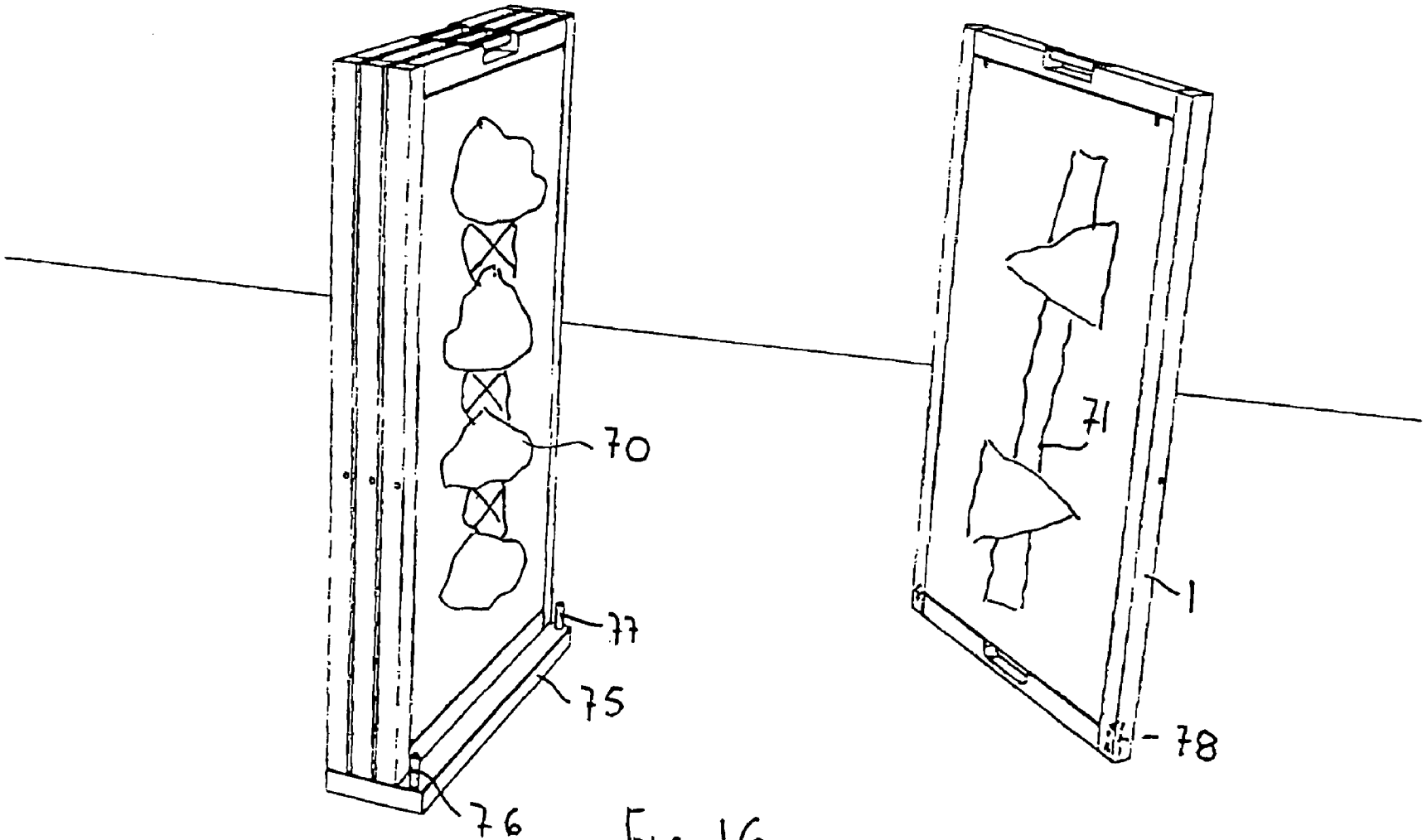
FIG. 16 is an isometric view of a number of chairs according to the invention stacked together with one removed to one side; and, FIG. 17 is a view of a chair according to the invention in the unfolded position and showing how three of the chairs have been converted into framed pictures and hung on a wall.

FIG. 16 shows how a number of the chairs in the folded position can be easily mounted on a stand 75 which carries two rows of pegs 76, 77. The lower ends of the support frames 1 being provided with accommodating blind bores 78.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A folding chair which can be opened from a folded closed position to an operative open position comprising a substantially rectangular open support frame, a lower part of which provides a front support leg when in the open position; a seat portion, a back portion having front and rear surfaces, a lower seat support, and a lower part of the lower seat support provides a rear support leg when in the open position; the seat portion, back portion and lower seat support being located within the rectangular open support frame and pivoted together and to the frame to allow the seat portion to extend between the lower seat support and the back portion and the lower seat support to lie parallel to each other within the rectangular open support frame when in the folded closed position, the back portion being pivotally connected to the rectangular open support frame through a sliding pivot, the seat portion being pivoted to the back portion and the lower seat support being connected to a lower part of the back support through at least one pivoted link or links the lower seat support having a recess or recesses for receiving the pivoted link or links when in the folded closed position, the lower part of the lower seat support rotating upwardly from a lower position where the lower part provides the rear support leg when the chair is in the open position to an upper position within the rectangular open support frame and the back portion rotating and sliding about the sliding pivot within the rectangular open support frame so that the rear facing surface thereof moves to become forward facing when the chair is closed to the folded closed position.

2. The folding chair as claimed in claim 1 in which the sliding pivot between the back portion and the rectangular open support frame includes a track extending lengthwise on the inside of each side of the rectangular support frame.

3. The folding chair as claimed in claim 1 in which the seat portion, the back portion and the lower seat support are made from a rigid sheet material.

4. The folding chair as claimed in claim 3 in which the lower seat support is connected to the lower portion of the back support through at least one link.

5. The folding chair as claimed in claim 4 in which the surfaces of the lower seat support and the back support are recessed to accommodate the link when the chair is in the folded closed position.

6. The folding chair as claimed in claim 1 which is made from wood, metal or a synthetic plastics material or a combination thereof.

7. The folding chair as claimed in claim 6 in which the metal is aluminum.

8. The folding chair as claimed in claim 6 in which the rectangular open support frame is made from metal and the seat portion, back portion and lower seat support are made from wood or a plastics material.

9. The folding chair as claimed in claim 1 in which the upper end of the support frame includes a lifting handle.

10. A folding chair as claimed in claim 1 which is convertible into a framed picture and which can be folded from an open position in which the chair provides a seat to a folded closed position in which the chair provides a framed picture, and in which the lower seat support, seat portion and back portion when in the closed folded position, are all enclosed within said rectangular open support frame and form a substantially flat continuous surface, and an image carried on said surface which is surrounded by said rectangular open support frame.

11. A folding chair which is convertible into a framed picture as claimed in claim 10 in which a substantially flat continuous surface to carry an image is provided on both sides of the folded chair.

12. A folding chair which is convertible into a framed picture as claimed in claim 10 in which the substantially flat continuous surface is provided by a surface of said back portion.

13. The folding chair which is convertible into a framed picture as claimed in claim 12 in which the seat portion, the back portion and the lower seat support are made from a rigid sheet material.

14. The folding chair which is convertible into a framed picture as claimed in claim 13 in which the lower seat support is connected to the lower portion of the back support through at least one link.

15. The folding chair which is convertible into a framed picture as claimed in claim 14 in which the surfaces of the lower seat support and the back support are recessed to accommodate the link when the chair is in the folded closed position.

16. A folding chair which is convertible into a framed picture as claimed in claim 10 in which the substantially flat continuous surface is provided by a surface of a lower seat support which forms the rear leg or legs of the chair when in the open position.

17. The folding chair which is convertible into a framed picture as claimed in claim 10 in which the substantially flat continuous surface is provided by a surface of a lower seat support which forms the rear leg or legs of the chair when in the open position in combination with a surface of said seat portion.

18. The folding chair which is convertible into a framed picture as claimed in claim 10 which is made from wood, metal or a synthetic plastics material or a combination thereof.

19. The folding chair which is convertible into a framed picture as claimed in claim 10 in which the rectangular open support frame is made from metal and the seat portion, back portion and lower seat support are made from wood or a plastics material.

20. The folding chair which is convertible into a framed picture as claimed in claim 10 in which the upper end of the rectangular open support frame includes a lifting handle.

21. A folding chair which is convertible into a framed picture comprising a rectangular open support frame having a lower part which provides a front support leg when the chair is in the open position; a seat portion, a back portion slildably and pivotally connected to the rectangular open support frame and pivotally connected to the seat portion and a lower seat support pivotally connected to the rectangular open support frame, seat and back portions, a lower part of the lower seat support provides a rear support leg when the chair is in the open position; the seat portion, back portion and lower seat support being located within the rectangular open support frame and pivoted together and to the frame to allow the seat portion to extend between the lower seat support and the back portion and to lie parallel within the rectangular open support frame when in the folded closed position, the back portion being pivotally connected to the rectangular open support frame through a sliding pivot slidable along side elements of the rectangular open support frame, and the lower seat support being connected to a lower part of the back support through a pivoted link or links the lower seat support having a recess or recesses for receiving the pivoted link of links when in the folded closed position, the lower part of the lower seat support rotating upwardly towards the back portion from a lower position where the lower part of the lower seat support provides the rear support leg when the chair is in the open position to an upper position within the rectangular open support frame and the back portion rotating and sliding with respect to the rectangular open support frame side elements so that a rear facing surface of the back portion becomes a forward facing surface when the chair is closed to the folded closed position.

22. The folding chair which is convertible into a framed picture as claimed in claim 21 in which the sliding pivot between the back portion and the rectangular open support frame includes a track extending lengthwise on the inside of each side of the rectangular open support frame.

* * * * *